US009271569B2

(12) United States Patent
Zaccai et al.

(10) Patent No.: US 9,271,569 B2
(45) Date of Patent: Mar. 1, 2016

(54) RECONFIGURABLE TABLE

(71) Applicant: Herman Miller, Inc., Zeeland, MI (US)

(72) Inventors: Gianfranco Zaccai, Needham, MA (US); Kevin Young, Needham, MA (US); Peter Bates, Concord, MA (US); John F. Aldrich, Grandville, MI (US); Andrew J. Kurrasch, Saugatuck, MI (US); Robert M. Seeley, Zeeland, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 14/204,120

(22) Filed: Mar. 11, 2014

(65) Prior Publication Data

US 2014/0360412 A1 Dec. 11, 2014

Related U.S. Application Data

(60) Provisional application No. 61/776,199, filed on Mar. 11, 2013.

(51) Int. Cl.
*A47B 57/00* (2006.01)
*A47B 23/04* (2006.01)

(52) U.S. Cl.
CPC ..... *A47B 23/046* (2013.01)

(58) Field of Classification Search
USPC ..... 108/95, 96, 49, 150; 248/406.1, 419, 248/132, 129, 161, 425
See application file for complete search history.

(56) References Cited

U.S. PATENT DOCUMENTS

| | | | | | |
|---|---|---|---|---|---|
| 468,112 | A | * | 2/1892 | Kohlstetde | 108/137 |
| 1,696,145 | A | | 12/1928 | Wagoner | |
| 1,815,954 | A | | 7/1931 | Opie | |
| 2,014,549 | A | | 9/1935 | Behm | |
| 2,520,450 | A | * | 8/1950 | Austin, Jr. | 248/125.1 |
| 2,680,314 | A | | 6/1954 | Snyder | |
| 2,713,437 | A | | 7/1955 | Broden | |
| 3,094,949 | A | | 6/1963 | Oom | |
| 3,157,379 | A | | 11/1964 | Platakis | |
| 3,286,663 | A | | 11/1966 | Mann et al. | |
| 3,648,628 | A | | 3/1972 | Davis | |
| 3,682,112 | A | | 8/1972 | Emrick | |
| 3,908,565 | A | * | 9/1975 | Burnett | 108/147 |
| 4,085,961 | A | | 4/1978 | Brown | |
| 4,307,672 | A | | 12/1981 | Shikimi | |
| 4,449,172 | A | | 5/1984 | Warshawsky | |

(Continued)

FOREIGN PATENT DOCUMENTS

| | | | |
|---|---|---|---|
| WO | WO 03/024333 | A1 | 3/2003 |
| WO | WO 2004/113168 | A1 | 12/2004 |

*Primary Examiner* — Jose V Chen
(74) *Attorney, Agent, or Firm* — Michael Best & Friedrich LLP

(57) ABSTRACT

A table includes a vertical support column and a base. The base includes a first floor engaging portion disposed on a first side of a vertical axis and a second floor engaging portion disposed on an opposite second side of the vertical axis. The first and second floor engaging portions are weighted such that the base has a center of gravity spaced from the vertical axis on the second side of the vertical axis. A worksurface member is supported by the vertical support column and is vertically spaced from the base. The worksurface member is rotatable relative to the base. In one aspect, the worksurface member has an overall length greater than the overall length of the base. In another aspect, a stop limits rotation of the worksurface member.

25 Claims, 7 Drawing Sheets

(56) References Cited

U.S. PATENT DOCUMENTS

| | | | | |
|---|---|---|---|---|
| 4,480,556 | A | 11/1984 | Wilson et al. | |
| 4,672,898 | A | 6/1987 | Davidson | |
| 4,706,575 | A | 11/1987 | Hamlin | |
| 4,715,295 | A | 12/1987 | Hartman et al. | |
| 4,779,540 | A | 10/1988 | Dion et al. | |
| 4,848,710 | A | 7/1989 | Newman | |
| 4,862,811 | A | 9/1989 | Davis | |
| 4,863,124 | A | 9/1989 | Ball et al. | |
| 4,922,836 | A | 5/1990 | Damico | |
| 4,974,808 | A | 12/1990 | Ball | |
| 5,144,898 | A * | 9/1992 | Posly | 108/148 |
| 5,159,846 | A | 11/1992 | Warner | |
| 5,328,415 | A | 7/1994 | Furutani et al. | |
| 5,335,651 | A | 8/1994 | Foster et al. | |
| 5,354,023 | A * | 10/1994 | Meeks | 248/129 |
| 5,377,598 | A | 1/1995 | Kirchner et al. | |
| 5,452,531 | A | 9/1995 | Graville et al. | |
| 5,460,059 | A | 10/1995 | Kato | |
| 5,460,105 | A | 10/1995 | Given, Jr. | |
| 5,473,997 | A | 12/1995 | Solomon et al. | |
| 5,513,579 | A | 5/1996 | Allan | |
| 5,696,574 | A | 12/1997 | Schwaegerle | |
| 5,701,826 | A | 12/1997 | Dodgen | |
| 5,775,234 | A | 7/1998 | Solomon et al. | |
| 5,778,573 | A | 7/1998 | Nottingham et al. | |
| 5,951,423 | A | 9/1999 | Simpson | |
| 6,029,587 | A | 2/2000 | Rozier, Jr. et al. | |
| 6,058,845 | A | 5/2000 | Kelm | |
| 6,109,187 | A | 8/2000 | Cottle et al. | |
| 6,126,562 | A | 10/2000 | Brangenfeldt | |
| 6,158,359 | A | 12/2000 | Allan et al. | |
| 6,195,820 | B1 | 3/2001 | Heimbrock et al. | |
| 6,199,490 | B1 | 3/2001 | Langer | |
| 6,220,116 | B1 * | 4/2001 | Warner | 74/813 C |
| 6,327,982 | B1 | 12/2001 | Jackson | |
| 6,361,459 | B1 | 3/2002 | Serkh et al. | |
| 6,484,648 | B1 | 11/2002 | Long | |
| 6,488,602 | B1 | 12/2002 | Ebert | |
| 6,543,369 | B1 | 4/2003 | Swensson et al. | |
| 6,615,744 | B1 | 9/2003 | Eckstein et al. | |
| 6,786,461 | B1 | 9/2004 | Tsai et al. | |
| 6,877,442 | B2 | 4/2005 | Helle | |
| 6,978,499 | B2 | 12/2005 | Gallant et al. | |
| 6,991,570 | B2 | 1/2006 | Serkh | |
| 7,032,522 | B2 | 4/2006 | George et al. | |
| 7,082,882 | B2 | 8/2006 | Heimbrock | |
| 7,131,155 | B1 | 11/2006 | Fernandez et al. | |
| 7,219,472 | B2 | 5/2007 | Gallant et al. | |
| D543,722 | S | 6/2007 | Cookson | |
| 7,229,374 | B2 | 6/2007 | Meckstroth et al. | |
| 7,243,386 | B2 | 7/2007 | Gallant et al. | |
| 7,314,010 | B2 | 1/2008 | George et al. | |
| 7,392,621 | B2 | 7/2008 | Gallant et al. | |
| 7,540,243 | B2 | 6/2009 | George et al. | |
| 7,758,002 | B2 | 7/2010 | Blackburn | |
| 7,871,046 | B2 * | 1/2011 | Munro et al. | 248/129 |
| 8,082,857 | B2 * | 12/2011 | George et al. | 108/50.01 |
| 8,100,061 | B2 * | 1/2012 | Hookway et al. | 108/50.01 |
| 8,316,777 | B1 * | 11/2012 | Rosing | 108/49 |
| 8,523,721 | B2 | 9/2013 | Marica | |
| 8,573,546 | B2 * | 11/2013 | Valles Navarro et al. | 248/161 |
| 8,887,644 | B2 * | 11/2014 | Edinger et al. | 108/42 |
| 2004/0163574 | A1 | 8/2004 | Schoenbach et al. | |
| 2005/0022702 | A1 | 2/2005 | Hunter | |
| 2005/0132935 | A1 | 6/2005 | Lahmann et al. | |
| 2006/0054751 | A1 | 3/2006 | Johnson et al. | |
| 2006/0137578 | A1 | 6/2006 | Noding | |
| 2007/0251165 | A1 | 11/2007 | Kern et al. | |
| 2008/0087202 | A1 | 4/2008 | George et al. | |
| 2008/0087204 | A1 | 4/2008 | Stanescu et al. | |
| 2008/0121150 | A1 | 5/2008 | Picchio | |
| 2009/0101047 | A1 | 4/2009 | Mulaw et al. | |
| 2009/0241807 | A1 | 10/2009 | George et al. | |
| 2010/0303603 | A1 * | 12/2010 | Galante et al. | 414/811 |
| 2011/0197796 | A1 * | 8/2011 | Bhave et al. | 108/147.19 |

* cited by examiner

FIG. 20
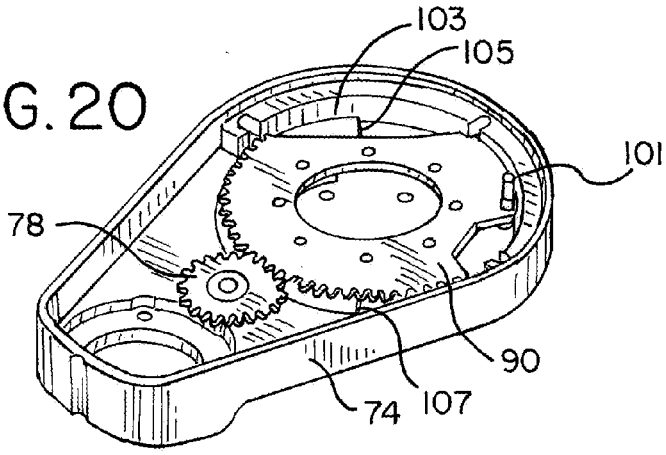
FIG. 21A
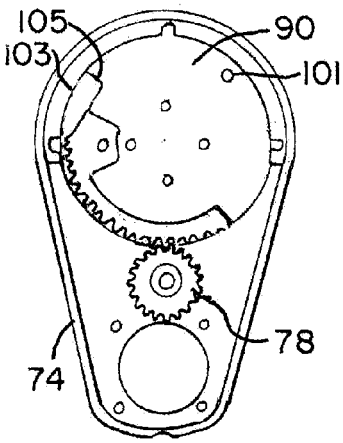
FIG. 21B
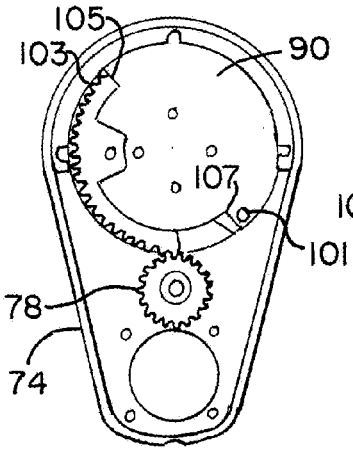
FIG. 21C
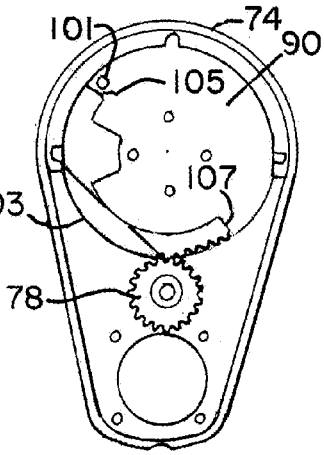
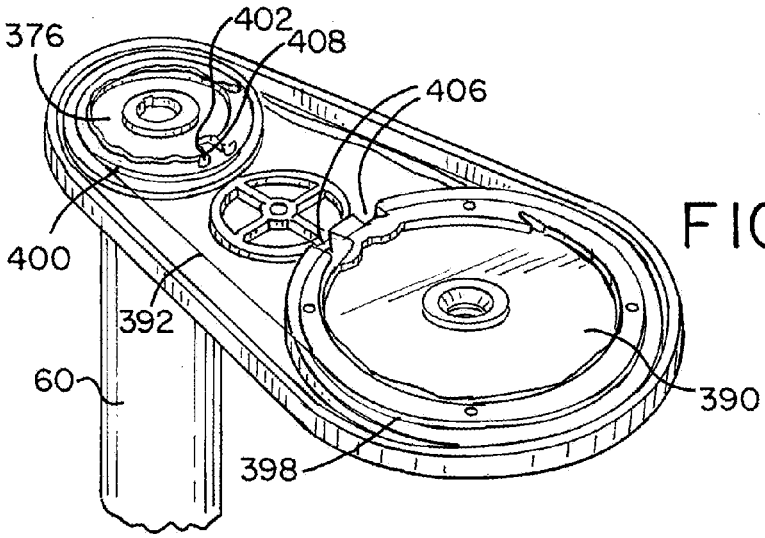
FIG. 22

RECONFIGURABLE TABLE

This application claims the benefit of U.S. Provisional Application No. 61/776,199, filed Mar. 11, 2013, the entire disclosure of which is hereby incorporated herein by reference.

TECHNICAL FIELD

The present invention relates generally to a table, and in particular to an table that is easily maneuverable and reconfigurable.

BACKGROUND

Tables, such as overbed tables, are typically configured with a worksurface that is positionable over a bed or chair for use by the occupant thereof. Typically, an overbed table is configured with a base that is positionable beneath the bed or chair. The base counter-balances the cantilevered weight of the worksurface, and any load applied thereto. The base may be configured with wheels, often lockable, such that the table is portable and may be easily maneuvered under/over the bed or chair, around a patient room and/or within adjacent hallways. Typically, however, the base has a length and/or width substantially the same as the worksurface so as to provide adequate counter-balance. To provide the requisite stability, the base occupies a relatively large footprint, thereby limiting the space in which it may be disposed, both from a height and depth perspective. Due to its length, width and height, the base may also interfere with the feet and/or gait of a transporter moving the table from one location to the next.

In addition, the worksurface is typically not rotatable relative to the base, so as to prevent the overbed table from tipping over. Accordingly, the entire overbed table, including the base, must be moved away from the bed when the worksurface is not needed, or the base must be positioned along the side of the bed if the user desires to use the worksurface as a side table. Either way, the base occupies floor space and may interfere with an efficient use of the room and otherwise impede the flow of traffic. Conversely, other overbed tables configured with a rotatable top typically require large footprints, or large bulky base configurations, to accommodate the variable, off-center cantilevered worksurface and any loads applied thereto.

SUMMARY

Briefly stated, in one aspect, one embodiment of a table includes a vertical support column and a base supporting the vertical support column along a vertical axis. The base includes a first floor engaging portion disposed on a first side of the vertical axis and a second floor engaging portion disposed on a second side of the vertical axis opposite the first side. The first and second floor engaging portions are weighted such that the base has a center of gravity spaced from the vertical axis on the second side of the vertical axis. The first and second floor engaging portions define in combination a first maximum overall length of the base along a horizontal direction. A worksurface member is supported by the vertical support column. The worksurface member is vertically spaced from the base. One or both of the worksurface member and support column are rotatable relative to the base. The worksurface member has a second maximum overall length along the horizontal direction. The second maximum overall length of the worksurface is greater than the first maximum overall length of the base. In one embodiment, the overbed table is supported by wheels engaging a floor, and is capable of being moved (e.g., pushed or pulled) about on the floor.

In another aspect, one embodiment of a table includes a worksurface member supported by a vertical support column and a stop operably interfacing with the worksurface member to limit rotation of the worksurface member about a vertical axis.

In another aspect, one embodiment of a table includes a first floor engaging portion having an arm extending in a horizontal direction along a horizontal axis intersecting said vertical axis. The first and second floor engaging portions are non-rotatable relative to each other. In one embodiment, the first floor engaging portion is substantially T-shaped.

In another aspect, one embodiment of a table includes a worksurface member rotatable at least 180 degrees relative to a base between opposite left and right hand orientations. A distal end of the worksurface member is spaced a first distance from the vertical axis when the worksurface member is in either of the left or right hand orientations. The worksurface is rotatable 90 degrees from either of the left or right hand orientations to an intermediate orientation. The distal end of the worksurface member is spaced a second distance from the vertical axis when the worksurface member is in the intermediate orientation. The second distance is greater than the first distance.

The various aspects and embodiments provide significant advantages over other tables, including for example overbed tables. For example and without limitation, the unique configuration of the floor engaging portions of the base reduces the overall footprint of the base, which in turn facilitates the maneuverability of the base beneath a bed or chair, decreases the possibility of posing a tripping hazard when being transported, and maximizes the available floor space when the table is being stored. In addition, the unique rotational movement of the worksurface allows for the table to be used in both overbed and side table configurations without having to move the base relative to the bed. In one embodiment, the wheels interfacing with the floor facilitate the maneuverability of the table.

The present embodiments of the invention, together with further objects and advantages, will be best understood by reference to the following detailed description taken in conjunction with the accompanying drawings.

BRIEF DESCRIPTION OF THE DRAWINGS

FIG. 20 is a perspective view of a rotation mechanism.

FIGS. 21A-C are plan views of the rotation mechanism shown in FIG. 20.

FIG. 22 is a perspective view of an alternative rotation mechanism.

DETAILED DESCRIPTION OF THE PRESENTLY PREFERRED EMBODIMENTS

Figure 1:
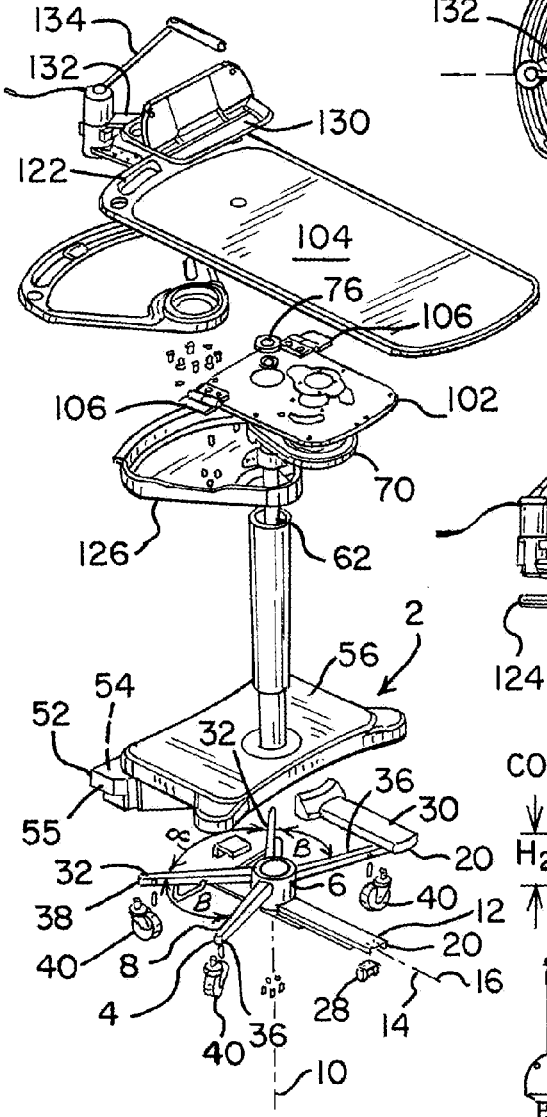
FIG. 1 is an exploded, perspective view of one embodiment of a table.
Figure 4:
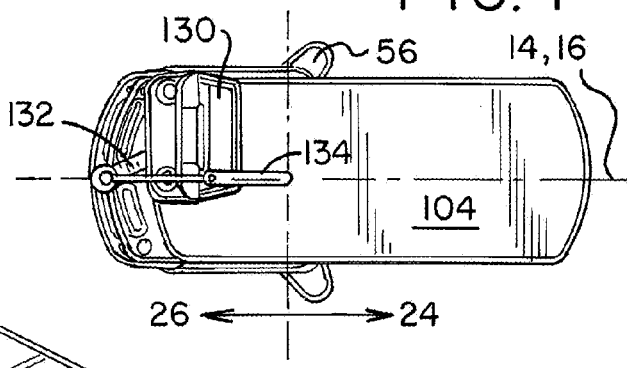
FIG. 4 is a top view of the table shown in FIG. 2.
Figure 2:
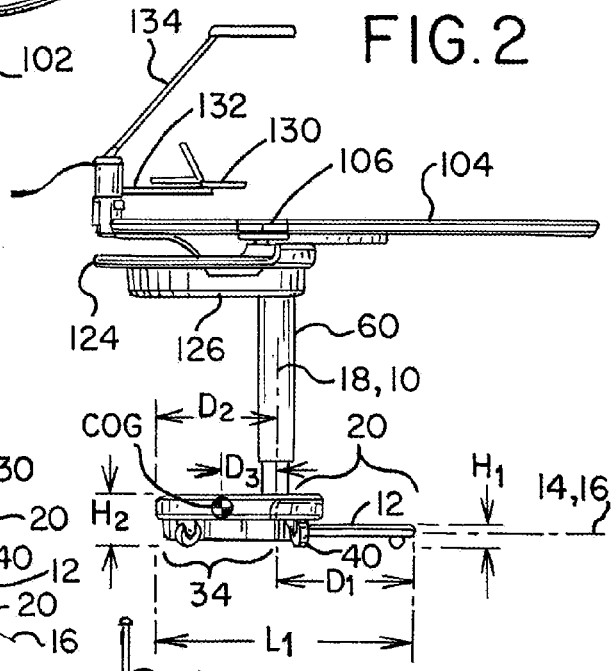
FIG. 2 is an assembled, side view of the table shown in FIG. 1.
Figure 3:
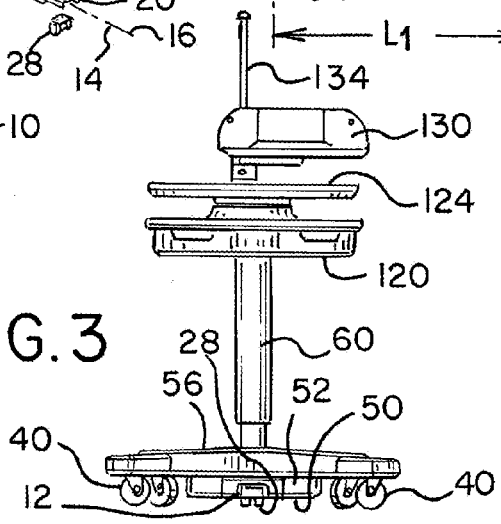
FIG. 3 is an end view of the table shown in FIG. 2.
Figure 8:
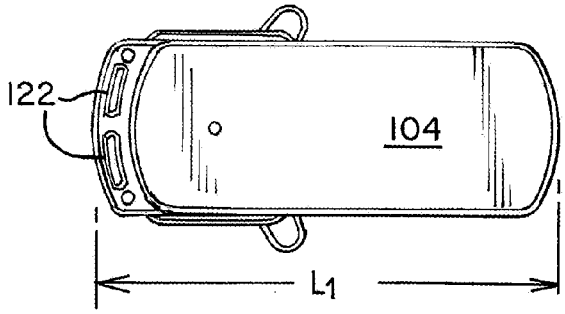
FIG. 8 is a top view of the table shown in FIG. 6.
Figure 5:
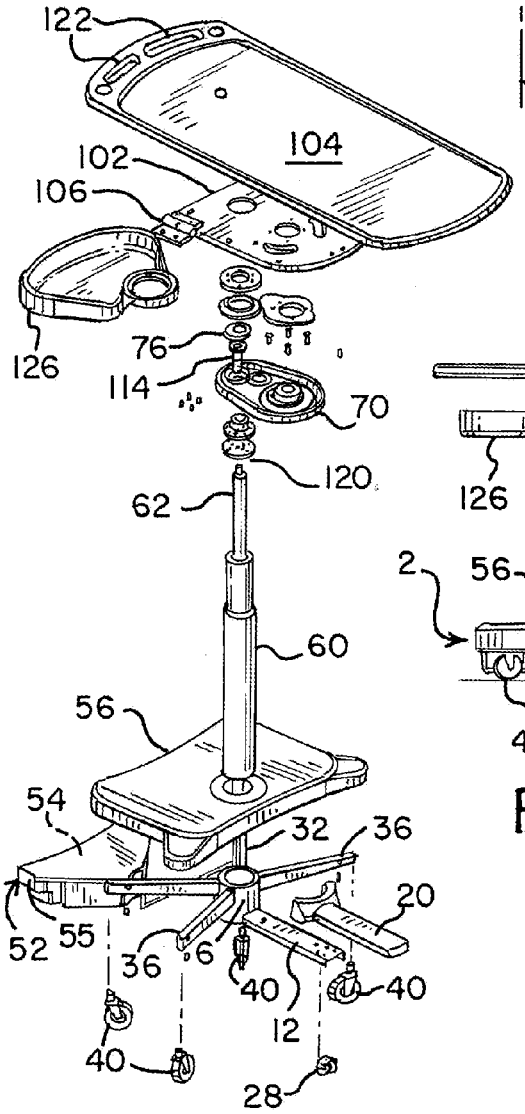
FIG. 5 is an exploded, perspective view of another embodiment of a table.
Figure 6:
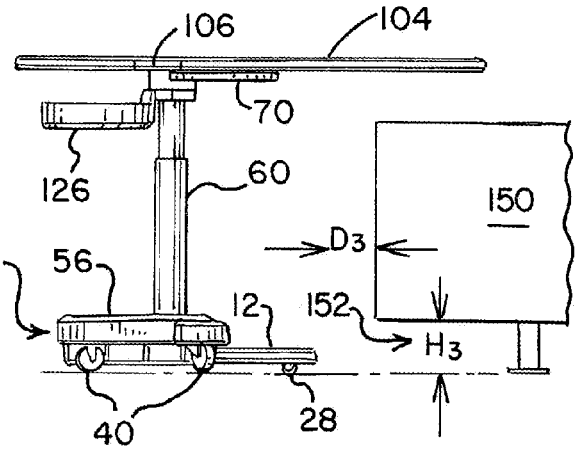
FIG. 6 is an assembled, side view of the table shown in FIG. 5.
Figure 7:
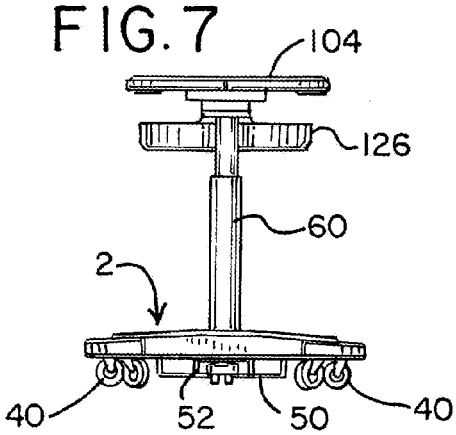
FIG. 7 is an end view of the table shown in FIG. 6.
Figure 9:
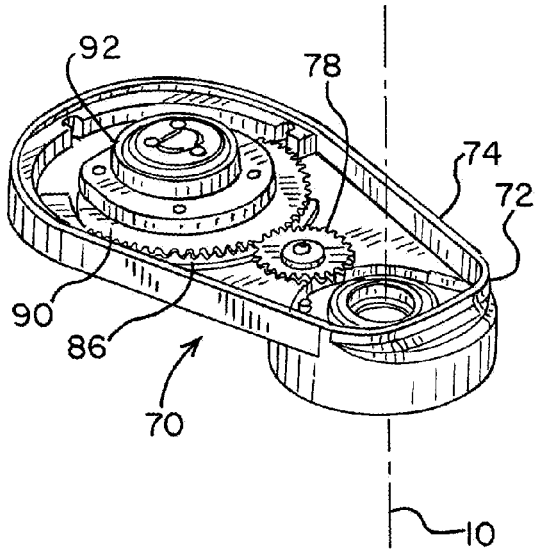
FIG. 9 is a perspective view of a rotation mechanism.
Figure 10:
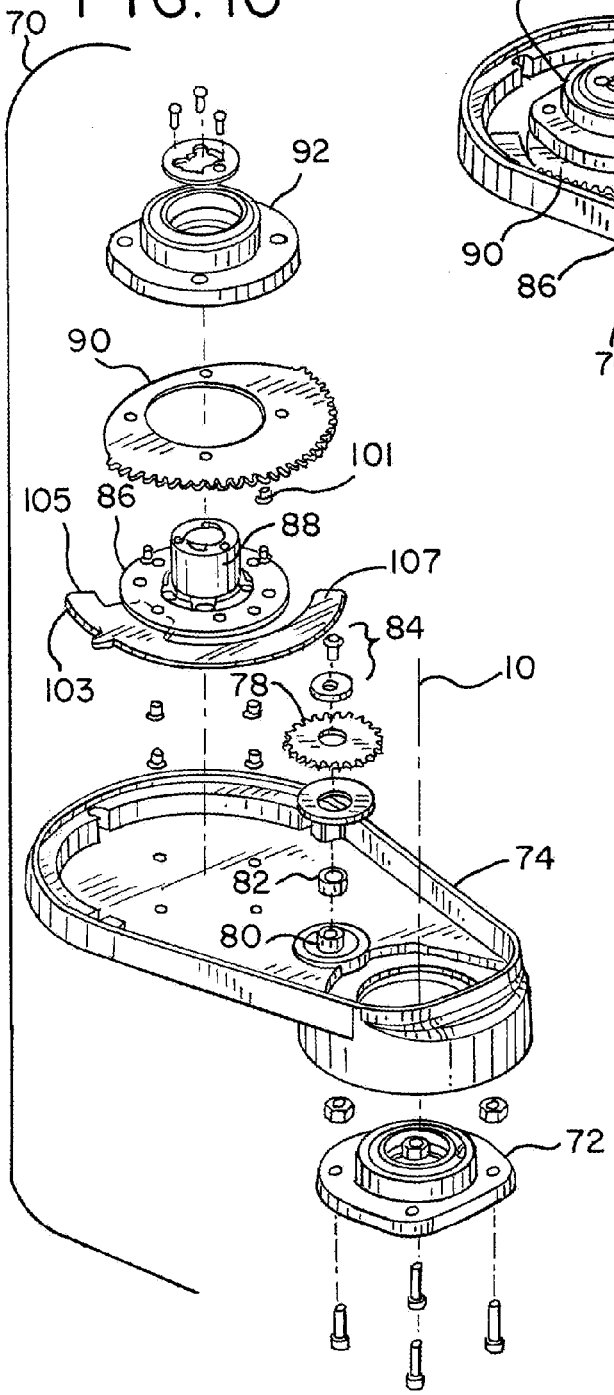
FIG. 10 is an exploded view of the rotation mechanism shown in FIG. 9.
Figure 11:
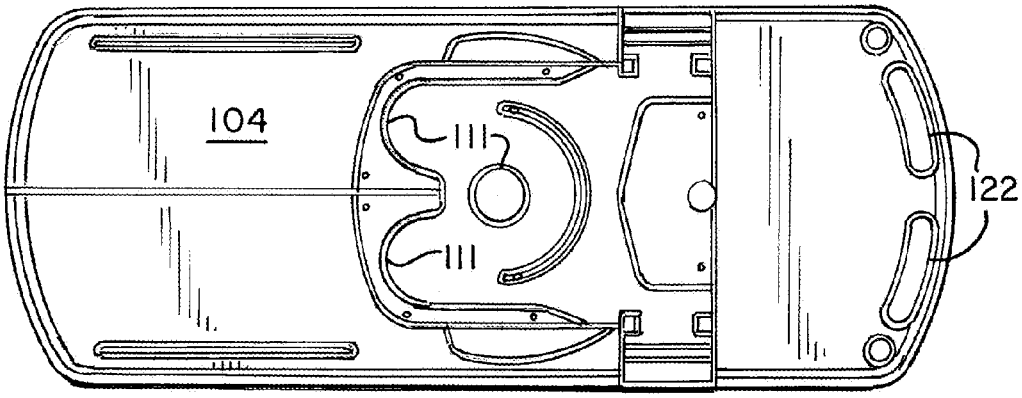
FIG. 11 is a bottom view of one embodiment of a worksurface.
Figure 12:
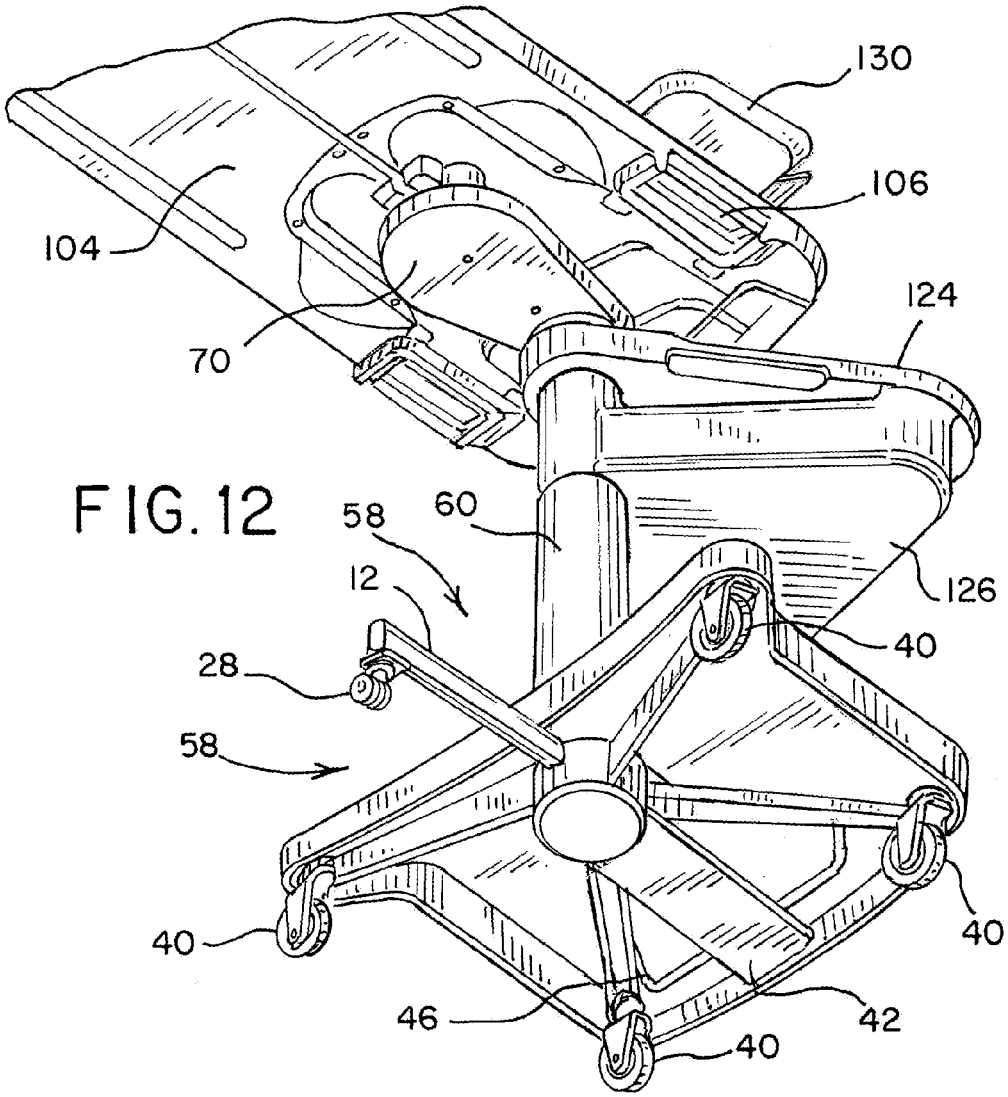
FIG. 12 is a partial, bottom perspective view of one embodiment of the table.
Figure 13:
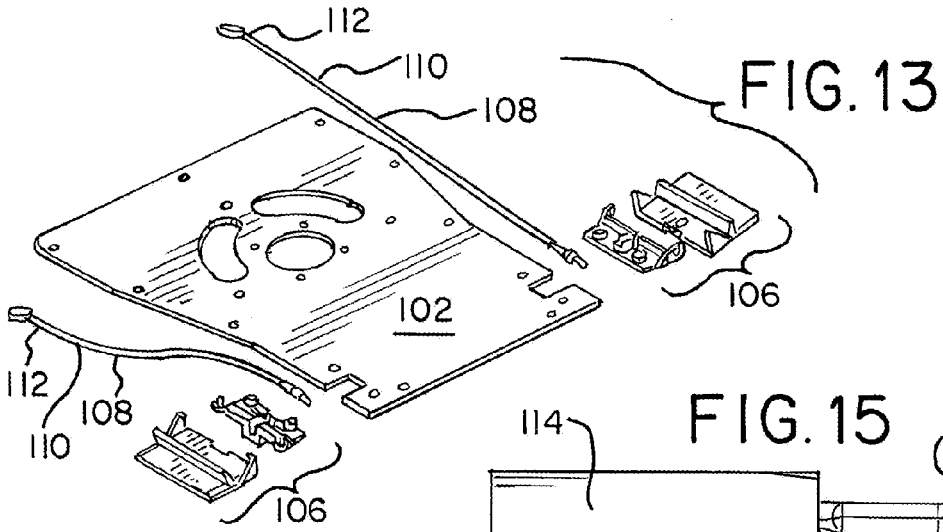
FIG. 13 is an exploded perspective view of a worksurface support assembly.
Figure 15:
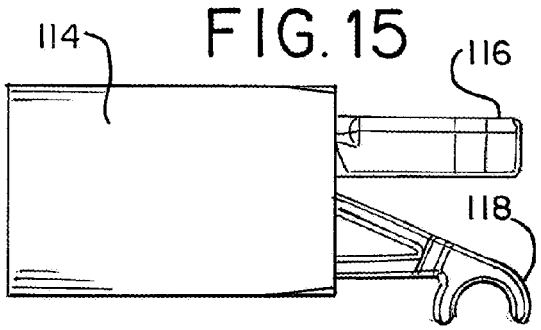
FIG. 15 is a side view of the actuator assembly shown in FIG. 14.
Figure 14:
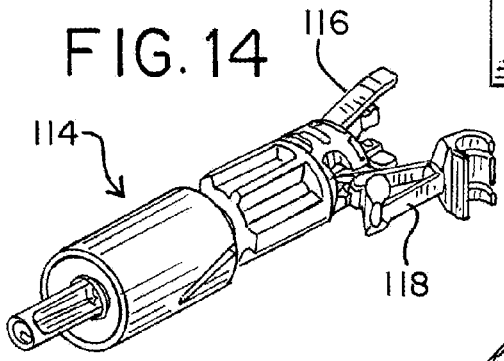
FIG. 14 is a perspective view of an actuator assembly.
Figure 16:
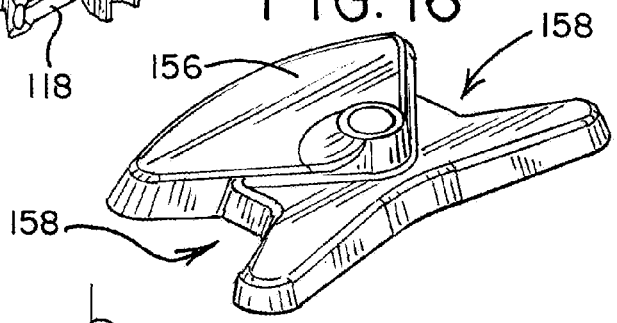
FIG. 16 is a perspective view of one embodiment of a base cover.
Figure 17:
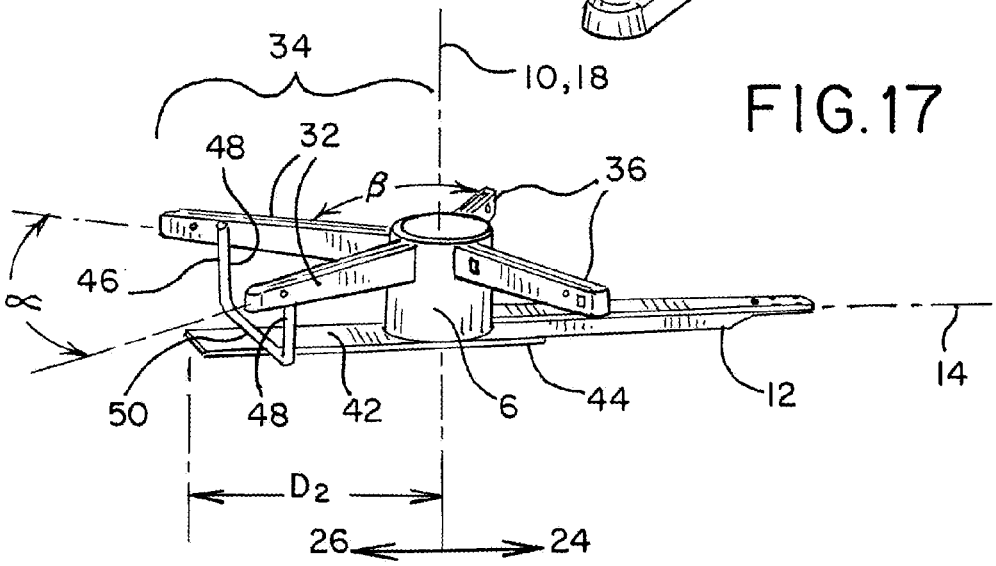
FIG. 17 is a perspective view of one embodiment of a base frame.

The terms "longitudinal" and "axial" as used herein relates to a length or lengthwise direction, including for example a lengthwise direction of a worksurface or a vertical support column, notwithstanding that those directions are substantially perpendicular respectively. The term "lateral" and variations thereof refer to a sideways direction. The terms "top" and "bottom" are intended to indicate directions when viewing the table when positioned for use. It should be understood that the term "plurality," as used herein, means two or more. The term "coupled" means connected to or engaged with, whether directly or indirectly, for example with an intervening member, and does not require the engagement to be fixed or permanent, although it may be fixed or permanent. The term "transverse" means extending across an axis, including without limitation substantially perpendicular to an axis. It should be understood that the use of numerical terms "first," "second," "third," etc., as used herein does not refer to any particular sequence or order of components; for example "first" and "second" portions may refer to any sequence of such portions, and is not limited to the first and second portions of a particular configuration unless otherwise specified.

Base and Support Column:

Referring to FIGS. 1-8, 12, 16 and 17, one embodiment of a base 2 includes a frame 4. The frame has a central hub 6 and a plurality of arms 8 extending radially outwardly from the hub. The hub 6 defines a vertical axis 10. The arms 8 are non-uniformly disposed around the perimeter of the hub 6. The plurality of legs includes a front arm 12 connected to the hub and defining a longitudinal axis 14 extending in a horizontal direction 16, with a vertical plane 18 lying substantially perpendicular to the longitudinal axis 14. The front arm is positioned with a maximum first height H1 (e.g., 2.28 inches in one embodiment with a cover and 1.76 inches without a cover) relative to a floor and has a distal end 20 spaced a distance D1 (e.g., 14.90 inches in one embodiment with a cover and 14.25 inches without a cover) from the vertical plane 18 and axis 10. The front leg defines in part a first floor engaging portion 22 disposed on a first side 24 of the vertical axis and plane. A wheel such as a caster 28, or other floor interface such as a glide, is coupled to the distal end and engages the floor. A cover 30 is positioned over and coupled to the front arm.

A first pair of arms 32 extends from the hub on an opposite side of the plane and axis and defines a second floor engaging portion 34. The arms 32 are symmetrically spaced relative to the longitudinal axis 14, and are angularly spaced at an angle $\alpha$ relative to each other. In one embodiment, $\alpha$ is about 95 degrees, although it should be understood that other angles would be suitable. A second pair of arms 36 extends from the hub on the first side of the axis and plane, with each arm 36 spaced at an angle $\beta$ relative to an adjacent one of the first pair of arms 32. The front arm 12 and second pair of arms 36 define the first floor engaging portion 20. In one embodiment, $\beta$ is about 60.5 degrees. Each of the first and second pair of arms 32, 36 are positioned with a maximum second height H2 (e.g., 5.68 inches in one embodiment with a cover and 4.74 inches without a cover) relative to the floor. In addition, each of the first and second pair of legs 38 has a distal end portion coupled to a wheel 40, caster, glide or other floor interface.

A support plate 42 is secured to the bottom of the hub and extends along the longitudinal axis on the second side 26 of the axis and plane 10, 18, forming a support shelf. A portion 44 of the plate extends along the longitudinal axis on the first side 24 and is coupled to the front leg 12. A support member 46, configured in one embodiment as a U-shaped wire (e.g., 0.375 inches in diameter) has upstanding end portions 48 connected to the firs pair of arms 32 and a horizontal portion 50 secured to and supporting the plate, e.g., by welding. The support plate 42, and second portion 34 extends a distance D2 (e.g., 9.00 inches in one embodiment without a cover and 11.3 inches with a cover) from the vertical axis 10 and plane 18 on the second side 26 thereof. In one embodiment, D1 is at least 25% of D2, at least 50% of D2 in other embodiments, and in some embodiments, D1 is greater than D2. The combined distances D1 and D2 define a maximum overall length of the base L1, which is about 26.20 inches in one embodiment with covers and 23.25 inches without covers.

A ballast container 52 is inserted into the space between the first pair of arms 32 and is supported by the support shelf 42. The ballast container 52 acts as a counterweight, and may be filled with ballast 54, including for example and without limitation, metal shot, water, or other known materials. It should be understood that the phrase "ballast container" is defined as including a component formed as an integral, solid weight, such as steel, iron, lead, etc. without a separate cover, coating, etc. The ballast container 52 may have side portions 55 that extend over and are supported by the first pair of arms 32. A cover 56, 156 is disposed over the first and second pairs of arms 32, 36 and the ballast container 52. The front arm 12 and the second pair of arms 36, alone or with the portion of the cover 56 lying on the first side 24 of the axis 10 and plane 18, define the first floor engaging portion 20, which is substantially T-shaped, with an open, pie-shaped space 58 formed on each of the opposite sides of the front arm 12. A second embodiment cover 156 also includes recesses 158 formed along side portions thereof so as to further reduce the footprint of the base 2.

The ballast container 52, hub 6, arms 12, 32, 36 and covers 30, 56, 156 are weighted and dimensioned such that the base 2 has a center of gravity (COG), or center of mass, located a distance D3 from the vertical axis 10 and plane 28 on the second side 26 of the axis and plane, notwithstanding that the first floor engaging portion 20 may extend a greater distance D1 from the axis 10 and plane 18 than the distance D2 of the second floor engaging portion 34.

A vertical support column 60 is secured to the hub 6 of the base and extends upwardly along the vertical axis 10. The support column 60 may be configured with a fixed height, or may be height adjustable. In the latter embodiment, the support column 60 includes a telescoping column assembly with a biasing device 62, such as a gas or hydraulic spring, disposed therein. The gas spring may be actuated by biasing an actuation pin located at the top of the spring.

Rotation Mechanism:

Referring to FIGS. 1, 5, 9, 10 and 20-21C, a rotation mechanism 70 includes a bearing pack 72 disposed on an upper end of the support column 60 and supporting a swing arm housing 74. The swing arm housing 74 is rotatable relative to the base about the vertical axis 10. In one embodiment, the swing arm housing 74 is rotatable relative to the support column 60, which is non-rotatably fixed relative to the base 2, while in other embodiments, the support column may be rotatable relative to the base and the housing fixed to the column A sun spur gear 76 is non-rotatably fixed to the column. An idler gear 78 is rotatably mounted to the swing arm housing on a hub 80 configured with a sleeve bearing 82 by way of a fastener assembly 84. The idler gear 78 meshes with the sun gear 76. A spindle 86 is secured to the swing arm housing and includes a central hub 88. A planet gear 90 and bearing assembly 92 are secured to the spindle.

As the swing arm housing 74 is rotated relative to the base 2 in a first angular direction (e.g., clockwise), the stationary sun gear 76 drives the idler gear 78, which also rotates in the clockwise direction. The rotating idler gear 78 in turn rotates the planet gear 90 and connected worksurface assembly 100 in an opposite counterclockwise direction.

A rotation limiter 101 is secured to the planet gear 90, and extends vertically therefrom. The rotation limiter 101 engages first and second stop surfaces 105, 107 formed on a stop member 103 secured to the swing arm housing 74. The stop member may be secured to the bottom of the swing arm housing 74, for example with fasteners or welding, or may be integrally formed therewith. As the planet gear 90 rotates relative to the swing housing 74, the rotation limiter 101 engages one of the first and second stops 105, 107 to limit the rotation of the worksurface to ±90 degrees relative to a neutral or intermediate position.

Other rotation systems may include various drive belt and cable/pulley mechanisms. For example, one belt driven mechanism is disclosed in U.S. patent application Ser. No. 13/366,819, filed Feb. 6, 2012 and entitled Self-Tensioning Drive Belt System, the entire disclosure of which is hereby incorporated herein by reference.

Referring to FIG. 22, another embodiment is configured with a sun sheave 376 fixed to the support column 60 and a planetary sheave 390 fixed to the worksurface. A pair of cables 392, 394 are disposed in circumferential grooves 398, 400 and wrapped around the sheaves 376, 390 in opposite directions, with enlarged end portions 402, 404 of the cables fixedly secured to the sheaves 390, 376, for example by insertion into a socket 406, 408. Of course, a single cable may be used. In operation, as the swing housing is rotated, the cables wrap around the sun sheave, without sliding, and thereby drive or rotate the planet sheave and worksurface. Of course, a toothed belt or chain may also be suitable and interface with sprockets rather than sheaves.

In an alternative embodiment, the worksurface 100 is simply rotatably coupled to the support column and pivots or rotates about the vertical axis 10.

Worksurface Assembly:

Referring to FIGS. 1-8 and 13-15, a worksurface support 102 is secured over and supported on the bearing and is non-rotatably secured to the planet gear 90. A worksurface 104 is secured to the worksurface support 102 with fasteners that engage insert nuts molded into the worksurface. The worksurface and/or support may include slots 111 shaped to receive actuation cable guides 110, such that a pass through is provided between an actuator handle 106 and the support column The worksurface 104 rotates with the planet gear 90 in an opposite direction relative to the swing arm housing 74, which rotates relative to the base 2. A pair of actuators 106, shown as pivot handles, are pivotally secured to opposite sides of the worksurface support 104. A pair of cable assemblies 108, each including a guide 110 and cable 112, are secured to the actuator handles 106 and have opposite ends coupled to an actuator 114 extending upwardly from the support column through the bearing. The actuator 114 has a stop 116 that engages a cable guide and a pivot arm 118 that engages end portions of the cables 112. As the cables are moved relative to the guides by way of pivoting the actuator handle 106, the pivot arm 118 is pivoted, which in turn depresses an axially extending pin 120 on the end of the biasing mechanism 62. The pin 120 in turn actuates the biasing mechanism 62 to raise the worksurface, or to allow a user to lower the worksurface by applying a downward load thereto.

In an alternative embodiment, the rotation mechanism is omitted, with the worksuface simply rotatably coupled to the top of the support column. The actuator assembly may be incorporated into the support column.

The worksurface 104 has an overall maximum length L2, e.g., about 48.00 inches in one embodiment. In one embodiment, the length L2 is greater than the length L1. In one embodiment, the worksurface 104 is configured with one or more handles 122 at one end thereof, which may be grasped for moving the overbed table on the floor, or for rotating the worksurface. In addition, an auxiliary handle 124 may be coupled to the support column 60. A pivotable storage drawer may 126 be pivotally secured to the column beneath the handle, and pivoted about the vertical axis 10 to provide access to an interior storage area therein.

As shown in FIGS. 1-4, an auxiliary worksurface 130 and/or storage assembly are secured to the worksurface member with a pivot arm 132. The assembly may include a communication interface, a mirror or other accessories. A light 134 may be rotatably mounted to the pivot arm.

Operation:

In operation, the overbed table may be grasped by one or more of the handles 122, 124 and moved about on the floor engaging interfaces 28, 40. The relatively short length and lower profile (height) of the front leg 12, together with the spaces 58 formed on each side thereof, allow for the overbed table to be positioned over various user interfaces 150, such as a bed or chair, having a relatively small space 152 thereunder, whether by depth D3 or height H3. At the same time, the base 2 has a small footprint that does not interfere with the transportation, positioning and/or storage of the table. The ballast 54, however, together with the unique footprint of the floor engaging portions, ensures that the table is extremely stable and not prone to tipping due to the position of the COG relative to the position of the worksurface in all positions.

Figure 18A:
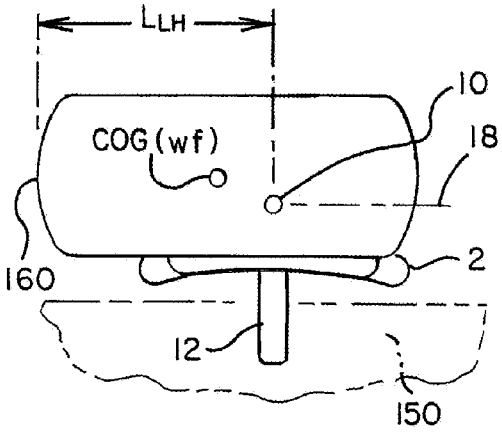
FIGS. 18A and B are top views of a one embodiment of a worksurface in left hand and intermediate configurations respectively.
Figure 18B:
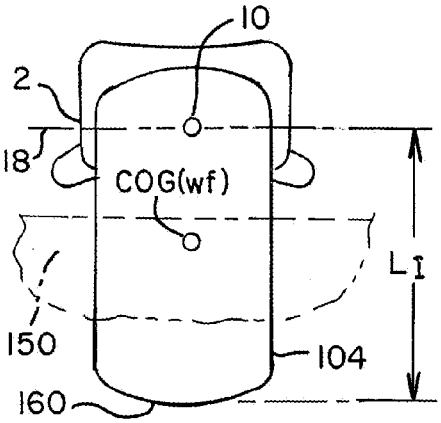
Figure 19A:
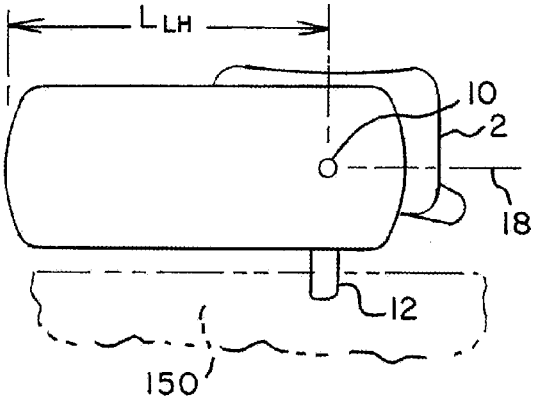
FIGS. 19A and B are top views of a one embodiment of a worksurface in left hand and intermediate configurations respectively.
Figure 19B:
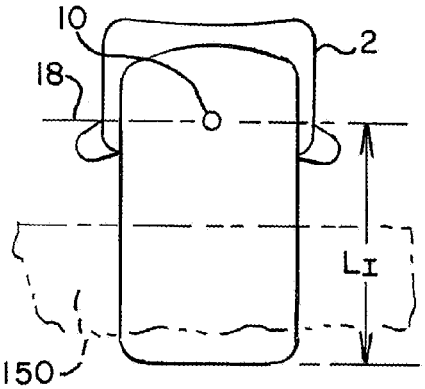

The worksurface 104 may be rotated in either a left hand or right hand direction from an intermediate position as shown in FIGS. 18A, B and 19A, B. In this way, the table may be stationed adjacent a user interface 150 with the base 2, and the front leg 12 (or portions thereof) in particular, located beneath the interface 150. If the user desires to use the worksurface 104 as a side table, the user simply rotates the worksurface 90 degrees in either direction. In the embodiment having a rotation mechanism, the gears 76, 78, 90 interface such that the worksurface 104 is rotated over the swing arm housing 74, with a distal end 160 of the worksurface 104 moving toward the vertical axis. For example, the distance L(LH) (left hand configuration) is less than L(I) (intermediate configuration). In this way, the center of gravity COG (WF) of the worksurface is maintained closer to the vertical axis when the table is in either of the right or left hand configurations, wherein the front leg 12 is not available to counter loads being applied to the worksurface 104. Alternatively, the worksurface 104 may be simply pivoted about the vertical axis 18 as shown in FIGS. 19A and B, wherein L(LH)=L(I). The COG (WF) may also be offset from the vertical axis on the same side of the axis as the second floor engaging portion 34.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A table comprising:

a vertical support column;

a base supporting said vertical support column along a vertical axis, wherein said base comprises a first floor engaging portion disposed on a first side of said vertical axis and a second floor engaging portion disposed on a second side of said vertical axis opposite said first side, wherein said first and second floor engaging portions are weighted such that said base has a center of gravity spaced from said vertical axis on said second side of said vertical axis, wherein said first and second floor engaging portions define in combination a first maximum overall length of said base along a horizontal direction; and a worksurface member supported by said vertical support column, wherein said worksurface member is vertically spaced from said base, wherein at least one of said worksurface member and said support column are rotatable relative to said base, and wherein said worksurface member has a second maximum overall length along said horizontal direction, wherein said second maximum overall length of said worksurface is greater than said first maximum overall length of said base, and wherein said worksurface member extends a greater distance from said vertical axis on said first side of said vertical axis than on said second side of said vertical axis.

2. The table of claim 1 wherein said worksurface member is rotatable at least 180 degrees relative to said base between opposite left and right hand orientations, and wherein said worksurface member is rotatable 90 degrees from either of said left or right hand orientations to an intermediate orientation.

3. The table of claim 2 wherein said first floor engaging portion comprises an arm extending in a horizontal direction along a horizontal axis intersecting said vertical axis, wherein said arm extends parallel to and underlies said worksurface member when said worksurface member is in said intermediate position.

4. The table of claim 3 wherein said arm has a first height and said second floor engaging portion has a second height, wherein said second height is greater than said first height.

5. The table of claim 2 wherein a distal end of said worksurface member is spaced a first distance from said vertical axis when said worksurface member is in either of said left or right hand orientations, and wherein said distal end of said worksurface member is spaced a second distance from said vertical axis when said worksurface member is in said intermediate orientation, and wherein said second distance is greater than said first distance.

6. The table of claim 5 further comprising a rotation mechanism operable coupled between said support column and said worksurface member, said rotation mechanism comprising a sun gear coupled to said support column, a planet gear coupled to said worksurface member and an idler gear disposed between and meshing with said sun gear and said planet gear.

7. The table of claim 1 wherein said first floor engaging portion extends a first distance from said vertical axis in said horizontal direction and said second floor engaging portion extends a second distance from said vertical axis in said horizontal direction opposite said first floor engaging portion, wherein said first distance is at least 25% of said second distance.

8. The table of claim 7 wherein said worksurface member extends a third distance from said vertical axis in said horizontal direction in an overlying relationship with said first floor engaging portion, wherein said third distance is greater than said first distance.

9. The table of claim 8 wherein said third distance is at least twice said first distance.

10. The table of claim 8 wherein said worksurface member extends a fourth distance from said vertical axis in said horizontal direction in an overlying relationship with said second floor engaging portion, wherein said fourth distance is greater than said second distance.

11. The table of claim 1 wherein said first floor engaging portion is substantially T-shaped.

12. The table of claim 1 wherein said second floor engaging portion comprises a ballast container fillable with ballast.

13. The table of claim 12 wherein said base further comprises a frame having a plurality of radially extending arms, wherein at least a pair of said arms support said ballast container, and a cover disposed over at least some of said arms and said ballast container.

14. The table of claim 1 wherein a distal end portion of said second floor engaging portion is disposed under said worksurface member when said second floor engaging member and said worksurface member are aligned along said horizontal direction.

15. The table of claim 1 further comprising a plurality of wheels coupled to said base and adapted to support said table on a floor.

16. The table of claim 1 wherein said vertical support column is height adjustable.

17. A table comprising:

a vertical support column;

a base supporting said vertical support column along a vertical axis, wherein said base comprises a first floor engaging portion disposed on a first side of said vertical axis and a second floor engaging portion disposed on a second side of said vertical axis opposite said first side, wherein said first and second floor engaging portions are weighted such that said base has a center of gravity spaced from said vertical axis on said second side of said vertical axis;

a worksurface member supported by said vertical support column, wherein said worksurface member is vertically spaced from said base, wherein one of said worksurface member and said support column are rotatable relative to said base about said vertical axis, wherein said worksurface member extends a greater distance from said vertical axis on said first side of said vertical axis than on said second side of said vertical axis; and a stop operably interfacing with said worksurface member to limit rotation of said worksurface member about said vertical axis.

18. The table of claim 17 wherein said worksurface member is rotatable at least 180 degrees relative to said base between opposite left and right hand orientations, and wherein said worksurface member is rotatable 90 degrees from either of said left or right hand orientations to an intermediate orientation.

19. The table of claim 18 wherein said first floor engaging portion comprises an arm extending in a horizontal direction along a horizontal axis intersecting said vertical axis, wherein said arm extends parallel to and underlies said worksurface member when said worksurface member is in said intermediate position.

20. The table of claim 18 wherein a distal end of said worksurface member is spaced a first distance from said vertical axis when said worksurface member is in either of said left or right hand orientations, and wherein said distal end of said worksurface member is spaced a second distance from said vertical axis when said worksurface member is in said intermediate orientation, and wherein said second distance is greater than said first distance.

21. The table of claim 20 further comprising a rotation mechanism operable coupled between said support column and said worksurface member, said rotation mechanism comprising a sun gear coupled to said support column, a planet gear coupled to said worksurface member and an idler gear disposed between and meshing with said sun gear and said planet gear.

22. The table of claim 17 wherein said worksurface member extends a greater distance from said vertical axis in said horizontal direction than said first portion.

23. The table of claim 17 wherein said first floor-engaging portion is substantially T-shaped.

24. The table of claim 17 wherein said second floor engaging portion comprises a ballast container fillable with ballast.

25. A table comprising:

a vertical support column;

a base supporting said vertical support column along a vertical axis, wherein said base comprises a first floor engaging portion disposed on a first side of said vertical axis and a second floor engaging portion disposed on a second side of said vertical axis opposite said first side, wherein said first and second floor engaging portions are weighted such that said base has a center of gravity spaced from said vertical axis on said second side of said vertical axis, wherein said first portion comprises an arm extending in a horizontal direction along a horizontal axis intersecting said vertical axis, wherein said first portion and said second portion are non-rotatable relative to each other and wherein said arm comprises at least one wheel coupled thereto along said horizontal axis; and a worksurface member supported by said vertical support column, wherein said worksurface member is vertically spaced from said base, wherein one of said worksurface member and said support column are rotatable relative to said base, and wherein said worksurface member extends a greater distance from said vertical axis on said first side of said vertical axis than on said second side of said vertical axis.

* * * * *